US005442838A

United States Patent [19]

Richardson et al.

[11] Patent Number: 5,442,838

[45] Date of Patent: Aug. 22, 1995

[54] ROLLING ACTION ZIPPER PROFILE AND SLIDER

[75] Inventors: Dale Richardson, Paoli, Pa.; Roger W. Smith, Grove City, Ohio

[73] Assignee: Mobil Oil Corporation, Fairfax, Va.

[21] Appl. No.: 262,117

[22] Filed: Jun. 17, 1994

[51] Int. Cl.[6] ..... A44B 19/00

[52] U.S. Cl. ..... 24/402; 24/399; 24/400; 24/587

[58] Field of Search ..... 24/400, 402, 399, 587, 24/576; 383/63, 65

[56] References Cited

U.S. PATENT DOCUMENTS

| | | | |
|---|---|---|---|
| 3,103,049 | 9/1963 | Hawley | 24/400 |
| 3,203,062 | 8/1965 | Ausnit | 24/400 |
| 3,220,076 | 11/1965 | Ausnit et al. . | |
| 3,347,298 | 10/1967 | Ausnit et al. | 150/3 |
| 3,426,396 | 2/1969 | Laguerre . | |
| 3,462,332 | 8/1969 | Goto | 156/244 |
| 3,579,747 | 5/1971 | Hawley | 24/400 |
| 3,660,875 | 5/1972 | Gutman . | |
| 3,713,923 | 1/1973 | Laguerre | 156/66 |
| 3,790,992 | 2/1974 | Herz . | |
| 3,806,998 | 4/1974 | Laguerre . | |
| 4,262,395 | 4/1981 | Kosky | 24/400 |
| 4,683,015 | 7/1987 | Wagers | 383/63 |
| 4,736,451 | 4/1988 | Ausnit . | |
| 4,878,763 | 11/1989 | Ausnit | 24/587 |
| 4,944,072 | 7/1990 | Robson | 24/576 |
| 5,007,143 | 4/1991 | Herrington | 24/400 |

*Primary Examiner*—Victor N. Sakran

*Attorney, Agent, or Firm*—Alexander J. McKillop; Malcom D. Keen; L. Gene Wise

[57] ABSTRACT

A plastic reclosable fastener with slider particularly suited for plastic bags and the like wherein the reclosable fastener is provided with structure located below the interlocking elements of the fastener which when engaged by the slider controls the opening and closing of the interlocking elements of the fastener.

6 Claims, 2 Drawing Sheets

ROLLING ACTION ZIPPER PROFILE AND SLIDER

BACKGROUND OF THE INVENTION

The present invention relates to improvements in plastic reclosable fasteners with sliders particularly suited for plastic bags and the like and particularly to rolling action zipper profiles which close by pressing the zipper together first at the bottom and then rolling it closed toward the top. A rolling action zipper profile with slider is disclosed in U.S. Pat. No. 5,007,143—Herrington. In that patent the cross-sectional shape of the plastic zipper profile was such that it can be closed by pressing the bottom together first, then rolling it closed toward the top to open the zipper, the slider was provided with a separator finger which engaged profile tracks extending along the length of the zipper and parallel to the male and female elements. The separator finger was shaped so as to separate the tracks and thus disengage the elements of the zipper at the opening end of the slider, and to allow the tracks to come together permitting engagement of the elements at the closing end of the slider.

It is an object of the present invention to eliminate the need for a separator finger on the slider and also to eliminate the need for tracks on the zipper for receiving the separator finger.

SUMMARY OF THE INVENTION

The present invention relates to a plastic reclosable fastener with slider particularly suited for plastic bags and the like comprising a pair of flexible plastic strips having separable fastener means extending along the length thereof comprising reclosable interlocking male and female profile elements on the respective strips, the strips including resilient flange structure depending from the male and female elements and having projections extending parallel to the male and female elements. The male and female elements have complementary cross-sectional shapes such that they are closed by pressing the bottom of the elements together first and then rolling the elements to a closed position toward the top thereof. A straddling slider is positioned on the strips for closing or opening the reclosable fastener elements comprising an inverted U-shaped plastic member having a back for moving along the top edges of the strips with sidewalls depending therefrom for cooperating with the reclosable fastener elements and extending from an opening end of the slider to a closing end. The sidewalls have a greater spacing at the opening end than the closing end. The slider also has shoulders projecting inwardly from the depending sidewalls and shaped throughout the length thereof for engagement with the depending flange structure between the projections and the male and female profile elements in creating the rolling action in opening and closing the reclosable interlocking male and female profile elements. The shoulders on the sidewalls have a greater spacing at the closing end of the slider than the opening end.

Further in accordance with the invention there is provided a plastic reclosable fastener of the rolling action type for use with a slider having depending sidewalls and inwardly projecting shoulders particularly suited for opening and closing the mouth of the plastic bags comprising reclosable interlocking rib and groove profile elements on the respective sides of the bag mouth, each of the profile elements having depending resilient flanges with projections extending parallel to the rib and groove profile elements for engagement of the flanges by the inwardly extending shoulders on the slider between the projections and the rib and groove profile elements. The rib and groove profile elements have complementary cross-sectional shapes such that they are closed by first pressing the bottom of the elements together and then rolling the elements to a closed position toward the top thereof.

In accordance with a further aspect of the invention there is provided a method of opening a plastic reclosable fastener with a slider wherein the fastener comprises reclosable interlocking rib and groove profile elements, each of the profile elements having depending resilient flanges with projections extending parallel to the rib and groove profile elements, the rib and groove elements having complementary cross-sectional shapes such that they are closed by first pressing the bottom of the elements together and then rolling the elements to a closed position toward the top thereof. A straddling slider is positioned on the profile elements having depending sidewalls and inwardly projecting shoulders extending from an opening end of the slider to a closing end, the sidewalls having a greater spacing at the opening end than the closing end and the inwardly projecting shoulders having a greater spacing at the closing end than the opening end, the method comprising the steps of moving the slider in an opening direction to cause the depending resilient flanges between the interlocked elements and the abutting projections to bend and come together and simultaneously causing the interlocking elements to rotate outwardly about the bottom of the elements and become disengaged.

For a more detailed disclosure of the invention and for further objects and advantages thereof, reference is to be had to the following description taken in conjunction with the accompanying drawings.

PREFERRED EMBODIMENT OF THE INVENTION

Figure 1:
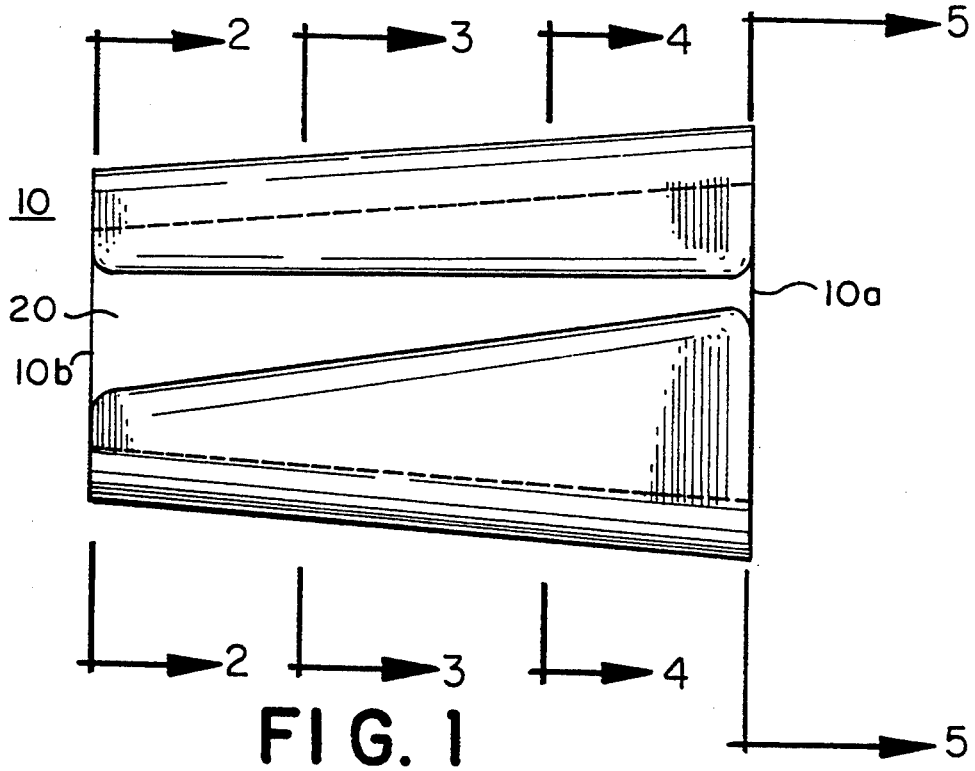
FIG. 1 is a bottom plan view of a plastic slider for opening and closing a plastic reclosable fastener embodying the present invention.

The present invention relates to a plastic reclosable fastener with slider particularly suited for plastic bags and the like as well known in the art. Referring to the drawings there is illustrated a plastic slider 10, FIG. 1, and a profiled plastic reclosable fastener or zipper, FIGS. 2–5, embodying the present invention. The zipper or reclosable fastener 11 is adapted to be secured at the top edge or mouth of a thermoplastic bag, not shown, in any conventional manner. The slider 10 and reclosable fastener 11 may be made from the same plastic materials disclosed in the aforesaid U.S. Pat. No. 5,007,143. As may be seen in FIGS. 2–5, the reclosable fastener 11 comprises a pair of flexible plastic strips 12, 13 having separable fastener means extending along the length thereof comprising reclosable interlocking male and female profile elements 14, 15 on the respective strips. The strips 12, 13 include resilient flange structure 16, 17 depending from the male and female elements 14, 15 and having projections 18 and 19 extending parallel to the male and female elements. The male and female elements 14 and 15 have complementary cross-sectional shapes such that they are closed by pressing the bottom of the elements together first and then rolling the elements to a closed position toward the top thereof. This progressive action is best illustrated in FIGS. 5, 4, 3 and 2.

The slider 10 is positioned in straddling position on the strips 12 and 13 for closing or opening the reclosable fastener 11. The slider 10 comprises an inverted substantially U-shaped plastic member having a back 20 for moving along the top edges of the strips 12, 13 with side walls 21 and 22 depending therefrom for cooperating with the reclosable fastener elements 14 and 15 and extending from an opening end 10a of the slider to a closing end 10*b*. The sidewalls 21 and 22 have a greater spacing at the opening end 10*a* than at the closing end 10*b*. The slider 10 also has shoulders 21*a* and 22*a* projecting inwardly from the respective depending sidewalls 21 and 22 and shaped throughout the length thereof for engagement with the depending flange structure 16 and 17 between the projections 18 and 19 and the male and female profile elements 14 and 15 in creating a rolling action in opening and closing the reclosable interlocking male and female profile elements. The shoulders 21*a* and 22*a* on the sidewalls 21 and 22 have a greater spacing at the closing end 10*b* of the slider 10 than the opening end 10*a*. This may clearly be seen in FIGS. 1, 2 and 5.

Figure 2:
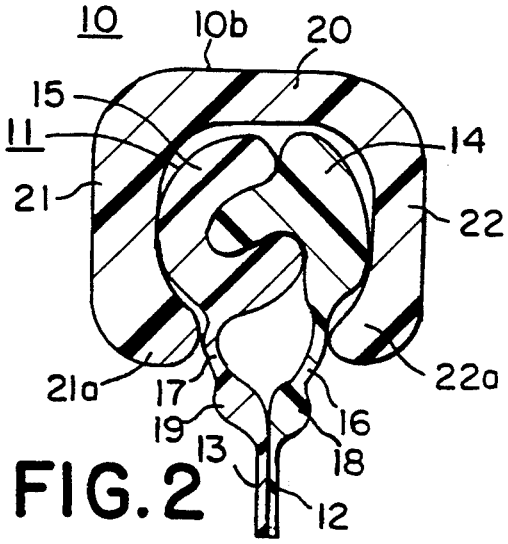
FIG. 2 is a sectional view taken along the lines 2—2 of FIG. 1 at the closing end of the slider and showing the slider assembled on the plastic zipper profile elements of the reclosable fastener in closed position and embodying the present invention.
Figure 3:
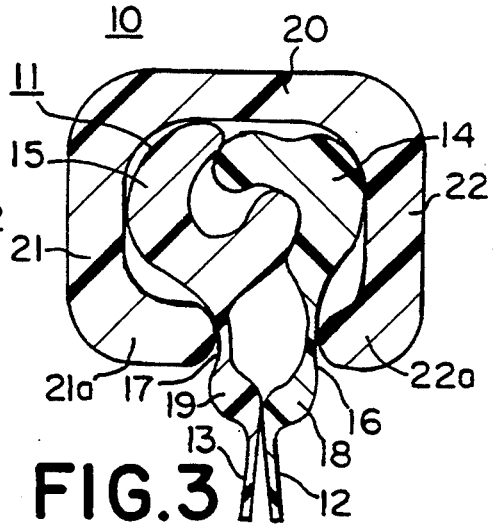
FIG. 3 is a sectional view taken along the lines 3—3 in FIG. 1 of the slider and showing the profile zipper elements in partially opened position.
Figure 4:
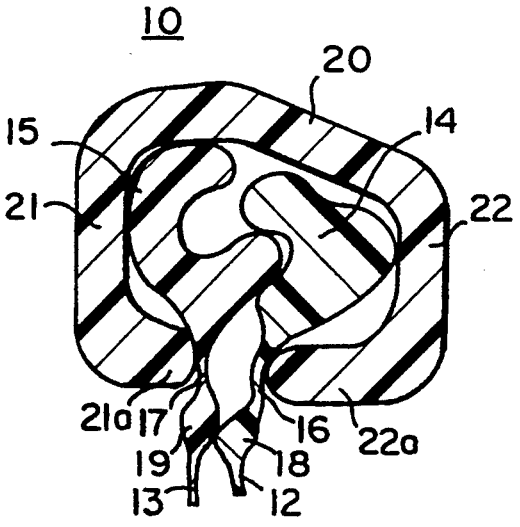
FIG. 4 is a sectional view taken along the lines 4—4 in FIG. 1 of the slider and showing the profile zipper elements in a further opened position from that shown in FIG. 3.
Figure 5:
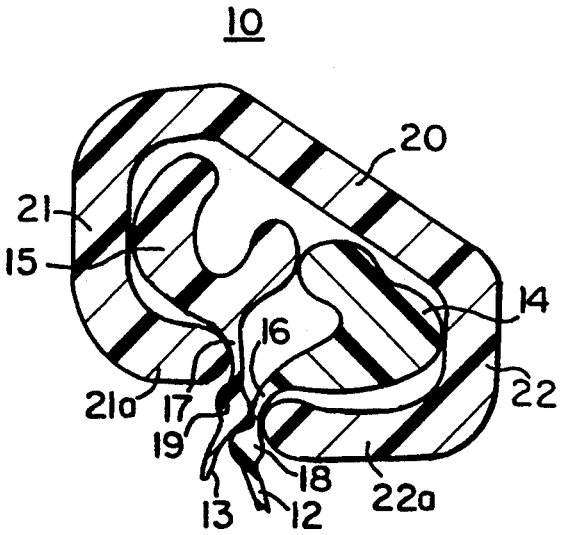
FIG. 5 is a sectional view taken along the lines 5—5 in FIG. 1 at the opening end of the slider and showing the zipper profile elements in opened position.

Referring to FIG. 2 it will be seen that the depending flanges 16 and 17 for the respective profiles 14 and 15 are spaced apart when the profiles 14 and 15 are interlocked. The relatively stiff portions or projections 18 and 19 of these flanges converge and abut a short distance below the interlocked portions of the profiles 14 and 15. As may be seen in FIG. 5 the shoulders 21*a* and 22*a* of the slider 10 converge to a narrow passage at the opening end 10*a* of the slider. As the profiles 14 and 15 encounter this portion of the slider 10, the flanges 16 and 17 between the interlocked elements 14 and 15 and the abutting projections 18 and 19 are forced to bend and come together, simultaneously causing the interlocking elements to rotate outwardly and become disengaged as shown in FIG. 5. The projections 18 and 19 are close to the interlocked elements 14 and 15 to prevent any one from pressing the flanges together, and thus opening the zipper 11, without using the slider 10.

To prevent the disengaged interlocking elements 14 and 15, FIG. 5, from relocking accidentally as they exit the opening end 10*a* of the slider, the end 10*a* of the slider 10 may be shaped to slightly offset one exiting profile 14 vertically from the other 15 if necessary. This has been illustrated in FIGS. 4 and 5 where it will be noted that the slider 10 provides a progressive vertical offsetting of the exiting profiles 14 and 15. As shown in FIG. 5 the shoulder 22*a* is located below the shoulder 21*a* which permits the profile 14 to be displaced vertically with respect to the profile 15 as they exit the slider 10. Thus, as the resilient flanges 16 and 17 are allowed to spring apart upon exiting the slider 10, the profile elements 14 and 15 will not be properly aligned to relock.

Figure 6A:
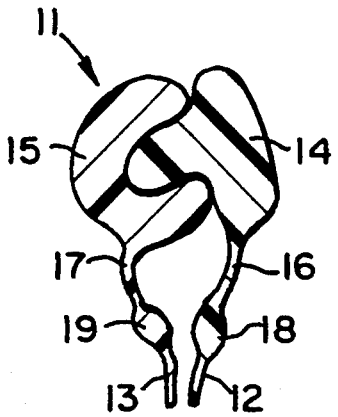
FIG. 6*a* represents the "normal" cross section of zipper profiles, as they would be everywhere except the location at which the narrow gap at the opening end of the slider would reside when the slider is parked on a fully closed bag.
Figure 6B:
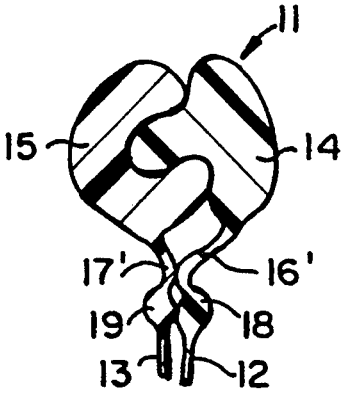
FIG. 6*b* illustrates a modified cross section of the zipper profiles fully interlocked and at the location of the narrow gap at the opening end of the slider when the slider is parked on a fully closed bag.

It is also desirable that at the end of the zipper 11 where the slider 10 must park when the bag is closed, provision be made for deforming the flanges 16, 17 so that the slider 10 does not disengage the interlocking profiles 14 and 15. In FIG. 6*a* there is an illustration of the "normal" cross-section of the profiles 14 and 15, as they would be everywhere except the location at which the narrow gap at the opening end 10*a* of the slider 10 would reside when the slider 10 is parked on a fully closed bag. At this location, the depending flanges 16' and 17' would be permanently reshaped, for example by thermal means, so as to lie adjacent to one another with the profiles 14 and 15 fully interlocked as shown in FIG. 6*b*. Thus, the narrow gap at the opening end 10*a* of the slider 10 will not be effective on the flanges 16 and 17 to separate the interlocked profiles 14 and 15 at this location when the zipper on the bag is fully closed.

While there has been described a preferred embodiment of the invention, it will be understood that further modifications may be made without departing from the spirit and scope of the invention as set forth in the appended claims.

What is claimed is:

1. A plastic reclosable fastener with slider particularly suited for plastic bags and the like comprising a pair of flexible plastic strips having separable fastener means extending along the length thereof comprising reclosable interlocking male and female profile elements on the respective strips, said strips including profile resilient flange structure depending from said male and female elements and having projections extending parallel to said male and female elements, said male and female elements having complementary cross sectional shapes such that they are closed by pressing the bottom of the elements together first and then rolling the elements to a closed position toward the top thereof, a straddling slider on said strips for closing or opening the reclosable fastener elements comprising an inverted U-shaped plastic member having a back for moving along the top edges of said strips with sidewalls depending therefrom for cooperating with said reclosable fastener elements and extending from an opening end of the slider to a closing end, said sidewalls having a greater spacing at the opening end than the closing end, said slider having shoulders projecting inwardly from said depending sidewalls, said shoulders have a greater spacing at the closing end of said slider than the opening end and shaped throughout the length thereof for engagement with said depending flange structure between said projections and said male and female profile elements in creating the rolling action in opening and closing said reclosable interlocking male and female profile elements.

2. A plastic reclosable fastener with a slider according to claim 1 wherein said shoulders on said sidewalls are displaced vertically from each other at said opening end of said slider to provide progressive vertical offsetting of the profile elements as they exit the slider.

3. A plastic reclosable fastener according to claim 1 wherein at the end of the reclosable fastener where the slider must park when the bag is closed, the depending flanges are permanently deformed to lie adjacent to one another with the profiles fully interlocked so that the opening end of the slider is ineffective to separate the interlocked profiles when the slider is moved to the parked position.

4. A plastic reclosable fastener of the rolling action type for use with a slider having depending sidewalls and inwardly projecting shoulders particularly suited for opening and closing the mouth of plastic bags comprising reclosable interlocking rib and groove profile elements on the respective sides of the bag mouth, each of said profile elements having depending resilient flanges with projections extending parallel to said rib and groove profile elements for engagement of said flanges by the inwardly extending shoulders on the slider between said projections and said rib and groove profile elements, said rib and groove profile elements having complementary cross-sectional shapes such that they are closed by first pressing the bottom of the elements together and then rolling the elements to a closed position toward the top thereof.

5. A method of opening a plastic reclosable fastener with a slider wherein the fastener comprises reclosable rib and groove profile elements, each of the profile elements having depending resilient flanges with projections extending parallel to the rib and groove profile elements, the rib and groove elements having complementary cross-sectional shapes such that they are closed by first pressing the bottom of the elements together and then rolling the elements to a closed position toward the top thereof, a straddling slider positioned on the profile elements having depending sidewalls and inwardly projecting shoulders extending from an opening end of the slider to a closing end, the sidewalls having a greater spacing at the opening end then the closing end and the inwardly projecting shoulders having a greater spacing at the closing end than the opening end, the method comprising the steps of moving the slider in an opening direction to cause the depending resilient flanges between the interlocked elements and the abutting projections to bend and come together and simultaneously causing the interlocking elements to rotate outwardly about the bottom of the elements and become disengaged.

6. A method according to claim 5 wherein the interlocking elements are progressively vertically offset as they become disengaged and exit the slider.

* * * * *